US008781711B2

(12) United States Patent
Han et al.

(10) Patent No.: US 8,781,711 B2
(45) Date of Patent: Jul. 15, 2014

(54) COMBUSTION DETECTING METHOD OF ENGINE

(75) Inventors: Kyoungchan Han, Hwaseong-si (KR); Sunghwan Cho, Yongin (KR); Myoungho Sunwoo, Seoul (KR); Seungsuk Oh, Siheung-si (KR); Jongsuk Lim, Seoul (KR); Jaesung Chung, Seoul (KR); Kangyoon Lee, Seoul (KR)

(73) Assignees: Hyundai Motor Company, Seoul (KR); IUCF-HYU (Industry-University Cooperation Foundation Hanyang University), Seoul (KR)

( * ) Notice: Subject to any disclaimer, the term of this patent is extended or adjusted under 35 U.S.C. 154(b) by 373 days.

(21) Appl. No.: 13/239,087

(22) Filed: Sep. 21, 2011

(65) Prior Publication Data

US 2012/0083992 A1 Apr. 5, 2012

(30) Foreign Application Priority Data

Sep. 30, 2010 (KR) ..... 10-2010-0094890

(51) Int. Cl.
*F02D 35/02* (2006.01)
*F02P 5/153* (2006.01)
*F02P 5/12* (2006.01)

(52) U.S. Cl.
CPC ..... *F02D 35/028* (2013.01); *F02P 5/153* (2013.01)
USPC ..... 701/102; 123/435

(58) Field of Classification Search
CPC ..... F02D 35/028; F02P 5/153
USPC ..... 701/101, 102, 103–105, 111; 123/435, 123/295, 406.26, 406.41, 406.43; 73/114.02, 114.08
See application file for complete search history.

(56) References Cited

U.S. PATENT DOCUMENTS

| | | | | |
|---|---|---|---|---|
| 4,905,648 | A | 3/1990 | Washino et al. | |
| 4,976,241 | A | 12/1990 | Ishida et al. | |
| 5,067,463 | A | 11/1991 | Remboski et al. | |
| 6,502,549 | B1 | 1/2003 | Hoshino et al. | |
| 6,980,903 | B2 | 12/2005 | Daniels et al. | |
| 7,171,950 | B2 * | 2/2007 | Palma et al. | 123/435 |
| 7,401,504 | B2 * | 7/2008 | Sunwoo et al. | 73/114.04 |
| 7,438,049 | B2 | 10/2008 | Caretta et al. | |
| 7,676,322 | B1 | 3/2010 | Kweon et al. | |

(Continued)

*Primary Examiner* — Mahmoud Gimie
(74) *Attorney, Agent, or Firm* — Morgan, Lewis & Bockius LLP

(57) ABSTRACT

A combustion phase detection method of an engine has the advantages of being able to reduce exhaust gas and to improve combustion stability, to compensate injection and ignition delay time between combustion chambers and between cycles, and to detect a combustion phase in real time such that a heat generation rate and heat release can be effectively calculated in an early state of combustion with a simple calculation method to control combustion of an engine, by using a combustion pressure and a motoring pressure difference of an engine not affected by an offset value of the cylinder pressure. For this, a combustion phase detection method may include detecting a combustion phase by using a specific point of DRdV as follows:

$$DRdV: \frac{P_{diff}\frac{dV}{d\theta}}{\max\left(P_{diff}\frac{dV}{d\theta}\right)}$$

Here, the Pdiff (P−Pmotoring) is a difference between a cylinder measure combust pressure (P) and a motoring pressure (Pmotoring), and V is a combustion chamber volume.

10 Claims, 7 Drawing Sheets

(56) References Cited

U.S. PATENT DOCUMENTS

| | | | | |
|---|---|---|---|---|
| 7,779,679 | B2 * | 8/2010 | Wang et al. | 73/114.52 |
| 7,831,377 | B2 * | 11/2010 | Akazaki et al. | 701/111 |
| 7,920,956 | B2 * | 4/2011 | Hillion et al. | 701/103 |
| 8,291,751 | B2 | 10/2012 | Wang et al. | |
| 2008/0178843 | A1 * | 7/2008 | Duffy et al. | 123/435 |
| 2008/0178848 | A1 * | 7/2008 | Duffy et al. | 123/481 |
| 2009/0312931 | A1 * | 12/2009 | Wang et al. | 701/102 |
| 2011/0077846 | A1 | 3/2011 | Zavala Jurado et al. | |
| 2011/0125388 | A1 * | 5/2011 | Catanese et al. | 701/103 |
| 2011/0224886 | A1 * | 9/2011 | Wang et al. | 701/103 |
| 2012/0083989 | A1 | 4/2012 | Han et al. | |

* cited by examiner

Cylinder pressure offset

Combustion phase detection error when cylinder pressure offset is formed

Combustion pressure and motoring pressure

A conventional Heat release (amount) and DRdV of this invention

DRdVx according to fuel injection timing

COMBUSTION DETECTING METHOD OF ENGINE

CROSS-REFERENCE TO RELATED APPLICATION

This application claims priority to and the benefit of Korean Patent Application No. 10-2010-0094890 filed Sep. 30, 2010, the entire contents of which application is incorporated herein for all purposes by this reference.

BACKGROUND OF INVENTION

1. Field of Invention

The present invention relates to a combustion phase detection method that uses a volume change rate and a pressure of a combustion chamber.

2. Description of Related Art

In an internal combustion engine, an abnormal combustion process, for example, knocking, can be generated by spontaneous combustion of an unburned mixture that a fire does not yet reach. Long continued knocking can damage components of the combustion chamber by an increment of heat load and pressure shock.

An important parameter that affects a knocking tendency of the internal combustion engine is ignition timing. If the fuel/air mixture in the combustion chamber is ignited too early, the knocking can be generated. Accordingly, after a knocking process is detected in the internal combustion engine, there is a method that retards ignition timing so as to prevent the knocking at a next combustion stroke.

Excessively retarded ignition is related to efficiency loss, and accordingly a knocking control apparatus is used to detect knocking during combustion in the internal combustion engine. This part of knocking control is knocking detection. Meanwhile, the ignition angle is adjusted during knocking control. Knocking control like this is published in an international patent application PCT/DE 91/00170. Other adjustment parameters such as fuel/air mixture, charging, compression ratio, an engine operating point, and so on can be varied so as to reduce knocking sensitivity of the internal combustion engine.

Also, knocking control is separately performed for each cylinder, and in addition to knocking detection, separately adjusting an ignition angle for each cylinder has been published. Since a structure difference of a cylinder, inequitable distribution of knocking sensors, and a related knocking signal of a cylinder generate differences of cylinders in knocking control, a separate knocking control for each cylinder is to be used to optimize efficiency thereof and simultaneously knocking sensitivity is deteriorated thereby.

If the phase detection portion, in which signals based on synchronization of ignition and knocking control are transferred, breaks down, a new demand condition is given to the knocking control that is separately performed for each cylinder. The knocking control is performed with maximum security and maximum accuracy so as to achieve maximum efficiency, due to possible damage of the internal combustion engine and stability of the combustion.

On this account, the necessity for the combustion phase control shows a steady growth to achieve stability of the combustion and noxious exhaust gas reduction.

Generally, the combustion phase control method includes calculating total heat release (referring to a total heat release of FIG. 1) by using the following Equation 1 and a pressure inside the combustion chamber, and detecting a combustion phase by using a specific point of the total heat release (for example, 50% of the total heat release, MFB 50: 0.5 value of axis y coordinate of FIG. 1).

$$\frac{dQ}{d\theta} = \frac{1}{\gamma - 1} V \frac{dP}{d\theta} + \frac{\gamma}{\gamma - 1} P \frac{dV}{d\theta} \qquad \text{Eq. 1}$$

However, since the above heat generation analysis method is based on a thermal dynamics rule and it is very complicated mathematically and has a large size of calculation load, it is effective in a case that it is analyzed at a theoretical side with sufficient time, but there is a drawback that it is difficult to apply it to the combustion of the engine that is performed in real time.

Also, in the combustion phase detection method that uses a 50% point of the heat generation (MFB 50), as shown in FIG. 2, there was a problem that a larger error is generated in detecting the combustion phase, in a case that an offset is formed in a sensor measure value by heat impact when the cylinder combustion pressure is measured, as shown in a square pattern mark coordinator of FIG. 3, compared to a normal circle mark coordinator.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention provide for a combustion phase detection method of an engine having advantages of being able to reduce exhaust gas and to improve combustion stability, to compensate injection and ignition delay time between combustion chambers and between cycles, and to detect a combustion phase in real time such that a heat generation rate and heat release can be effectively calculated in an early state of combustion with a simple calculation method to control combustion of an engine, by using a combustion pressure and a motoring pressure difference of an engine not affected by an offset value of the cylinder pressure.

One aspect of the present invention is directed to a combustion phase detection method may include detecting a combustion phase by using a specific point of DRdV through a following equation $$DRdV: \frac{P_{diff} \frac{dV}{d\theta}}{\max\left(P_{diff} \frac{dV}{d\theta}\right)}$$

Here, Pdiff (P−Pmotoring) is a difference between a cylinder measure combust pressure (P) and a motoring pressure (Pmotoring), and V is a combustion chamber volume.

The specific point for detecting the combustion phase may be within DRdV 0-50% and is within 0-20° based on a crank angle.

The specific point for detecting the combustion phase may be DRdV 50% and a crank angle 20°.

A normalization method of the DRdV may include calculating by applying a motoring pressure and a pressure difference that is formed by a combustion instead of a cylinder measure pressure P in a conventional heat release, calculating an approximate heat release value by ignoring a heat release rate by the motoring pressure having a very small amount, and normalizing, as illustrated by the following equations:

$$\frac{dQ}{d\theta} = \frac{1}{\gamma-1}V\frac{dP}{d\theta} + \frac{\gamma}{\gamma-1}P\frac{dV}{d\theta}$$

$$\frac{dQ}{d\theta} = \frac{1}{\gamma-1}V\frac{d(P_{diff}+P_{motoring})}{d\theta} + \frac{\gamma}{\gamma-1}(P_{diff}+P_{motoring})\frac{dV}{d\theta},$$

$$\text{where } P_{diff} = P - P_{motoring}$$

$$\frac{dQ}{d\theta} = \frac{1}{\gamma-1}\left(V\frac{dP_{diff}}{d\theta} + \gamma P_{diff}\frac{dV}{d\theta}\right) + \frac{1}{\gamma-1}\left(V\frac{dP_{motoring}}{d\theta} + \gamma P_{motoring}\frac{dV}{d\theta}\right)$$

$$\frac{dQ}{d\theta} \simeq \frac{1}{\gamma-1}\left(V\frac{dP_{diff}}{d\theta} + \gamma P_{diff}\frac{dV}{d\theta}\right).$$

Other aspects of the present invention are directed to an incipient combustion heat generation rate detection method and combustion phase detection method in which an incipient heat generation rate can be detected through a small amount of calculation, compared to a conventional heat generation rate detection method, and a combustion phase can be detected in real time by using a specific point of an incipient heat generation rate. This can be effectively applied to a combustion phase control system such that injection and ignition delay time between combustion chambers or between cycles is compensated, the exhaust gas is reduced, and the combustion stability is improved.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Figure 1:
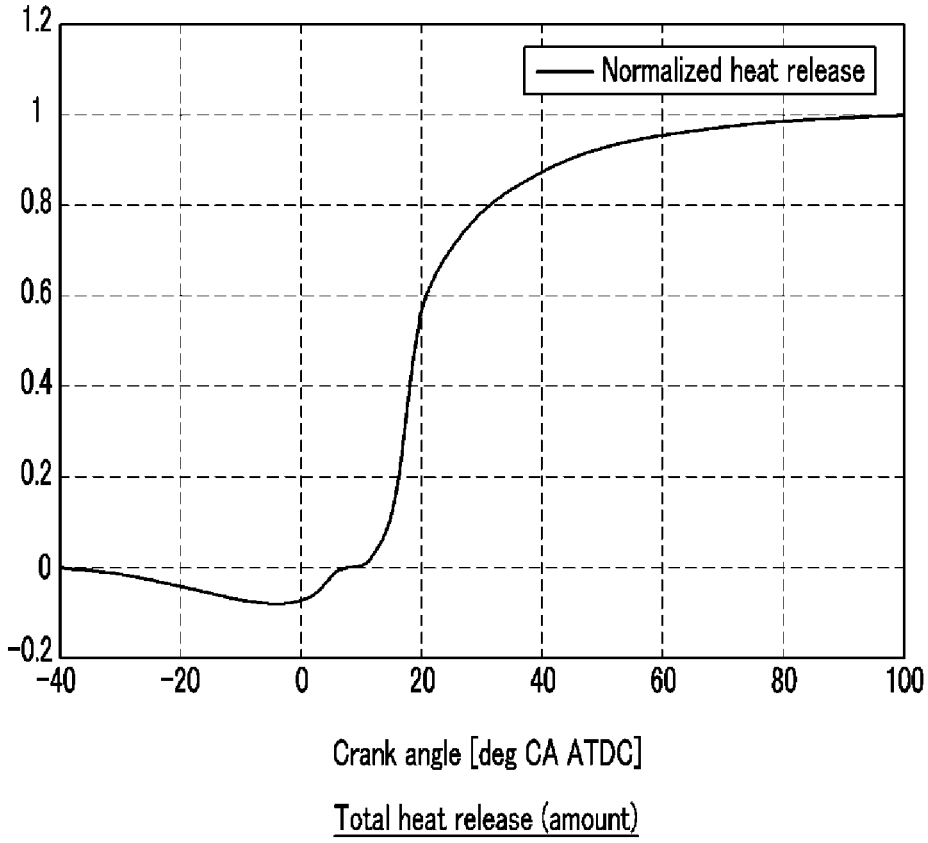
FIG. 1 is a graph showing conventional total heat release for controlling a combustion phase.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

A conventional fuel injection system uses feed-forward control. However, in spite of an equal fuel injection order, in a case that fuel injection is controlled by feed-forward control, the injection and the ignition can be delayed according to driving conditions of an engine such that the combustion phase is varied. Since the variation of the combustion phase increases exhaust gas or decreases combustion stability, the combustion phase is to be accurately controlled by feedback control.

For this, a conventional combustion phase detection method for controlling a combustion phase detects a combustion phase by using a specific point of heat release (for example, 50% of fuel mass burned, or MFB50), but it may cause an error of the combustion phase when an offset is generated by the cylinder pressure sensor and a calculation load is high such that real time control is hard to realize.

Given this point, because a difference of the combustion pressure and the motoring pressure are used in the present invention, it is not affected by an offset of the cylinder pressure, and a calculation load thereof is low in contrast to the conventional method to estimate a heat generation rate and a heat release at an early stage of the combustion with ease, and the method will be described hereafter.

The following Equation 1 is used to calculate a heat generation rate, a conventional cylinder measure combustion pressure P minus pressure (Pmotoring) is a pressure difference (Pdiff) that is generated by combustion to effectively control combustion, i.e. Pdiff=P−Pmotoring or P=Pdiff+Pmotoring, Pdiff+Pmotoring is applied instead of P in a conventional equation, and the heat generation rate of Equation 2 according to the present invention can be received.

$$\frac{dQ}{d\theta} = \frac{1}{\gamma-1}V\frac{dP}{d\theta} + \frac{\gamma}{\gamma-1}P\frac{dV}{d\theta} \qquad \text{Equation 1}$$

$$\frac{dQ}{d\theta} = \frac{1}{\gamma-1}V\frac{d(P_{diff}+P_{motoring})}{d\theta} + \frac{\gamma}{\gamma-1}(P_{diff}+P_{motoring})\frac{dV}{d\theta}, \qquad \text{Equation 2}$$

$$\text{where } P_{diff} = P - P_{motoring}$$

The above Equation 2 is arranged to be transformed to a following Equation 3.

$$\frac{dQ}{d\theta} = \frac{1}{\gamma-1}\left(V\frac{dP_{diff}}{d\theta} + \gamma P_{diff}\frac{dV}{d\theta}\right) + \frac{1}{\gamma-1}\left(V\frac{dP_{motoring}}{d\theta} + \gamma P_{motoring}\frac{dV}{d\theta}\right) \qquad \text{Equation 3}$$

However, the heat generation rate by the motoring pressure is a value that can be omitted in Equation 3, and resultantly the heat generation rate can be expressed as the following Equation 4 as an approximate value.

$$\frac{dQ}{d\theta} \simeq \frac{1}{\gamma-1}\left(V\frac{dP_{diff}}{d\theta} + \gamma P_{diff}\frac{dV}{d\theta}\right) \quad \text{Equation 4}$$

Next, $\gamma/\gamma-1$*Pdiff dV/dθ of the Equation 4 is normalized by a following Equation 5 (hereinafter, this normalized value or "normalized heat release" is DRdV (Difference pressure rate of heat release using dV term)), and a characteristic of the DRdV is used to detect a combustion phase according to a fuel injection.

$$DRdV: \frac{P_{diff}\frac{dV}{d\theta}}{\max\left(P_{diff}\frac{dV}{d\theta}\right)} \quad \text{Equation 5}$$

Hereinafter, the calculation method will be further described with reference to accompanying drawings.

FIG. 1 is a graph showing a result of total heat release that is calculated by detecting a combustion pressure inside a combustion chamber and substituting the detected pressure into Equation 1. This is a conventional method for combustion phase control, wherein a specific point of the total heat release (for example, 0.5 of axis y, that is a 50% point) is used to detect a combustion phase, but this is mathematically very complicated and a calculation load thereof is high as described above and therefore it is hard to apply this method in real time.

Figure 2:
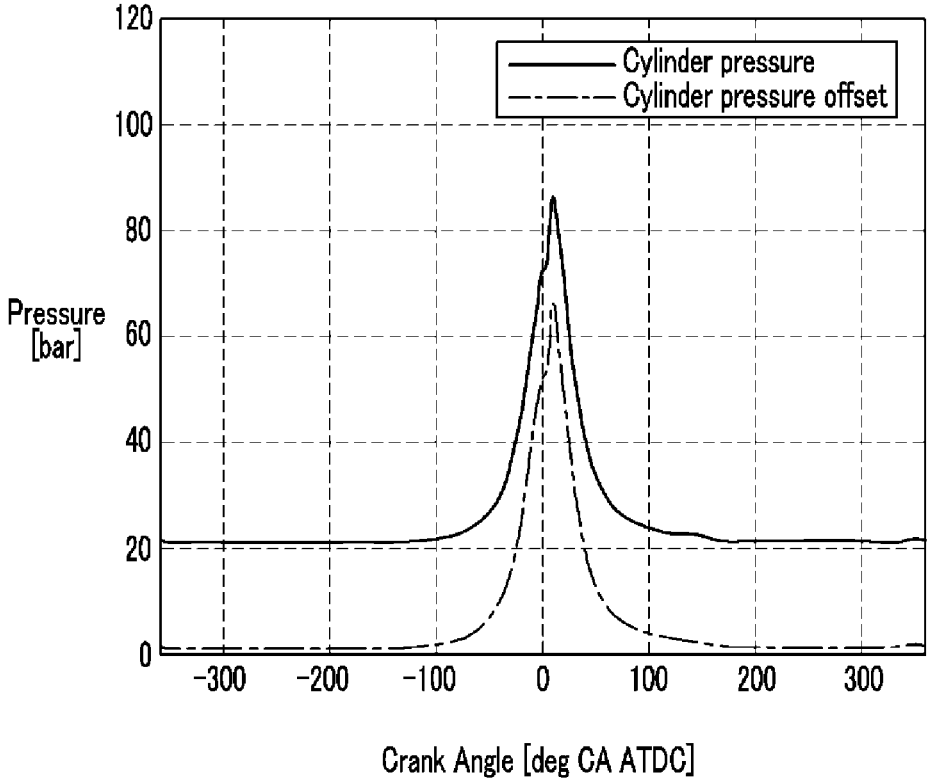
FIG. 2 shows that many errors are generated in a combustion phase, in case an offset is generated in a sensor measure value by heat impact when a cylinder combustion pressure is measured, wherein the upper curve is a normal cylinder pressure and the lower curve is a cylinder pressure in a case of an offset.

Also, as shown in FIG. 2, in a case that an offset is generated in a measured value of a sensor by a heat impact when a cylinder combustion pressure is measured, a larger error is formed in a combustion phase. The upper curve is a normal cylinder combustion pressure, the lower curve is a cylinder pressure in an offset case, and a difference between both curved lines is an error.

Figure 3:
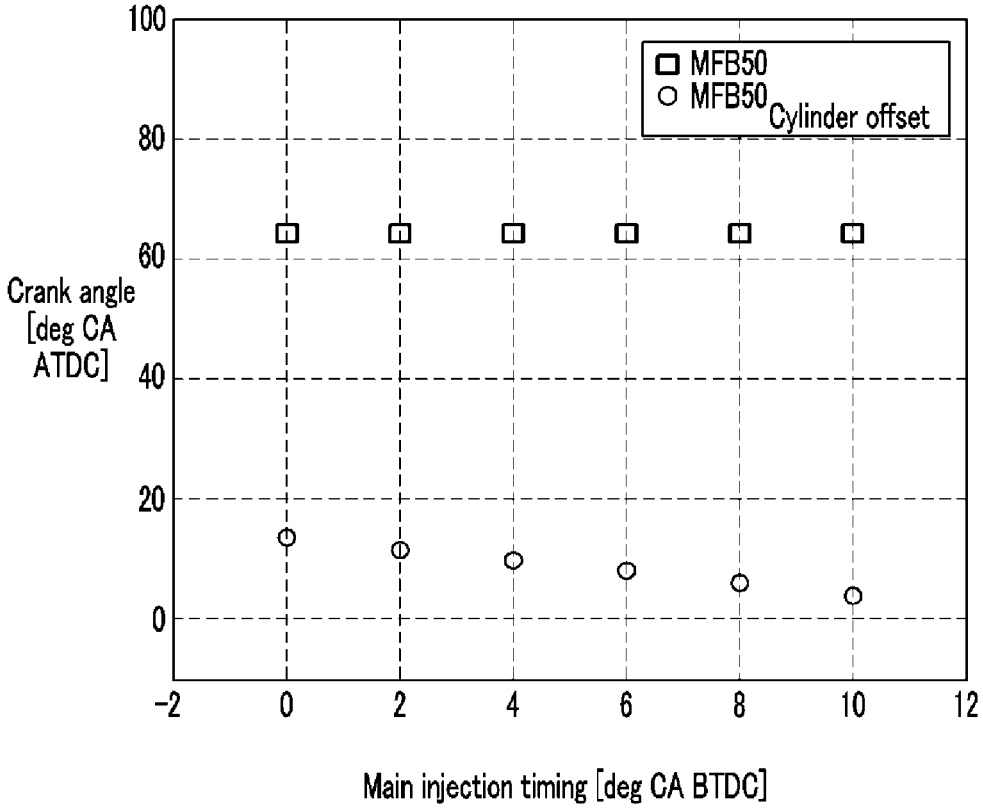
FIG. 3 shows a result of a combustion phase detection, which uses a 50% point of heat release (e.g., 50% of fuel mass burned or MFB50), wherein an upper end square mark is a combustion phase when a cylinder pressure offset occurs, and a lower end circle mark is an MFB50 of a normal condition to show that there is an error as large as a height difference between both sides in combustion phase detection.

FIG. 3 shows a result of combustion phase detection, which uses a 50% point of heat release (for example, 50% fuel mass burned, or MFB50), wherein an upper end square mark is a combustion phase when a cylinder pressure offset occurs, and a lower end circle mark is an MFB50 of a normal condition to show that there is an error as large as a height difference between both sides in combustion phase detection.

Figure 4:
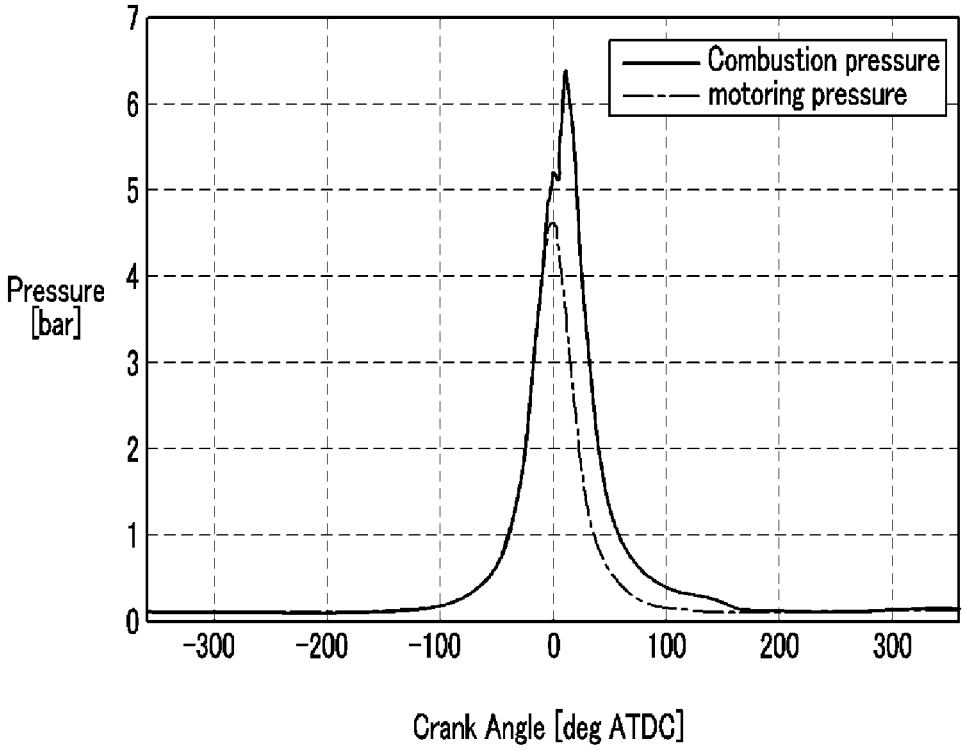
FIG. 4 is a combustion pressure and motoring pressure graph.

FIG. 4 is a combustion pressure and motoring pressure graph, wherein a cylinder combustion pressure curve and a motoring pressure curve coincide at the left side of a peak point, and there is a little difference therebetween at the right side thereof.

Figure 5:
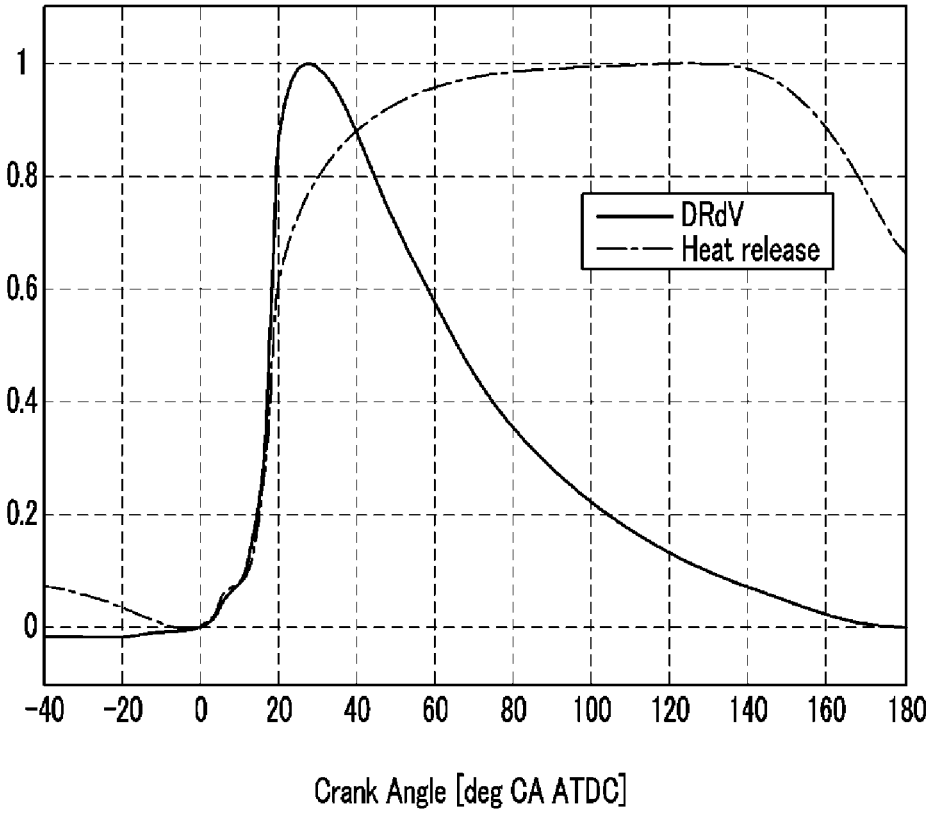
FIG. 5 is a graph that compares DRdV as heat release of the present invention with a conventional heat release.

FIG. 5 is a graph showing a relation between a conventional heat release and a DRdV that is heat release of the present invention, this graph compares a normalized heat release (DRdV) that is calculated by integrating $\gamma/\gamma-1$*Pdiff dV/dθ of the Equation 4 through the Equation 5 with a normalized heat release that is calculated by integrating a conventional Equation 1.

As shown in the FIG. 5, while the combustion is performed, the DRdV and a conventional heat release is almost the same characteristic (i.e., both curved lines almost coincide) until the heat release reaches 50% (around 0.5 of Axis y, crank angle 20° of Axis x), wherein if the characteristic of the DRdV according to the present invention is used, the combustion phase according to the fuel injection is accurately and simply detected.

Figure 6:
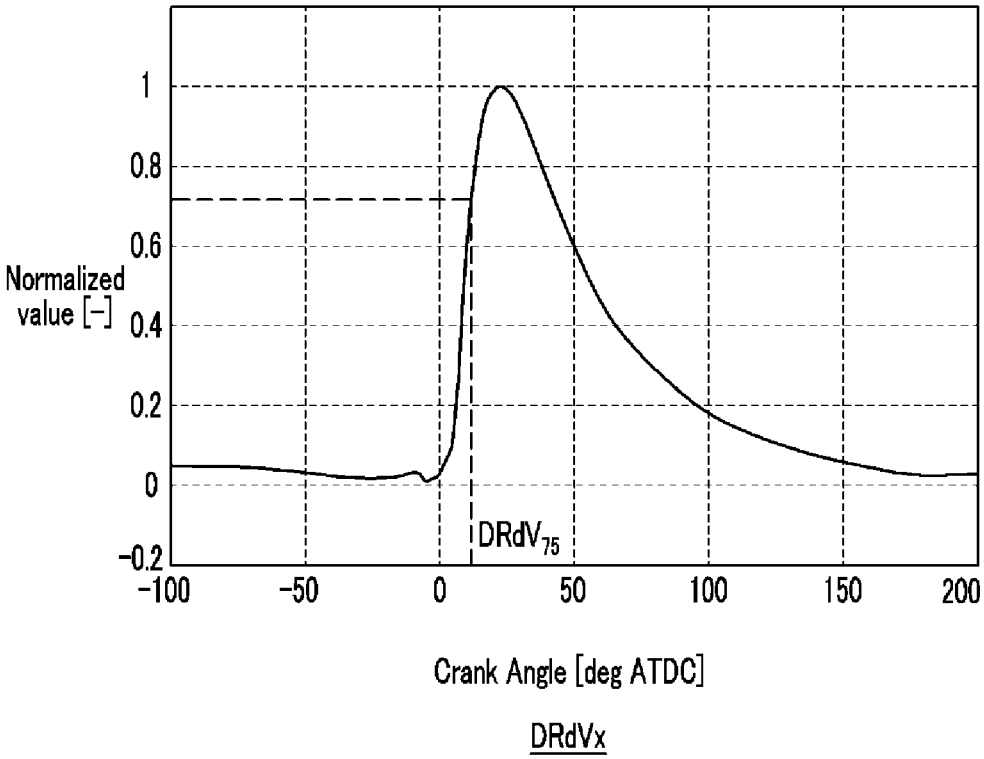
FIG. 6 is a graph showing a relationship between a crank angle and a normalized value of DRdV of the present invention.
Figure 7:
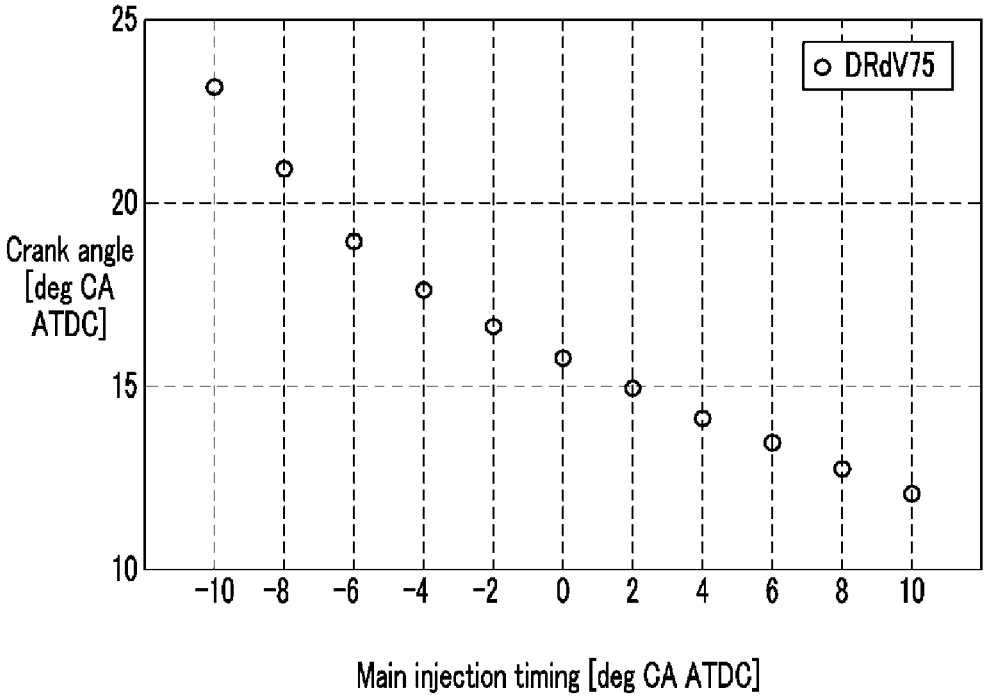
FIG. 7 is a graph showing a 40% point of DRdV, which is normalized, according to fuel injection timing of the present invention.

FIG. 6 is a DRdV graph of the present invention, if a specific point (this is marked as DRdVx, for example, 50% point denotes DRdV50, and 75% point denotes DRdV75) of the DRdV is used, the combustion phase can be detected, the detected value is usefully used in the combustion phase control, for one example, FIG. 7 shows a 75% point (DRdV75) of DRdV according to a fuel injection timing, wherein it can be confirmed that a combustion phase is varied according to a variation of a fuel injection timing.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

For convenience in explanation and accurate definition in the appended claims, the terms upper or lower, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A combustion phase detection method, comprising:

determining, by an engine control unit (ECU), a pressure difference (Pdiff) between a cylinder measure combust pressure (P) and a motoring pressure (Pmotoring), wherein Pdiff=P−Pmotoring;

calculating, by the ECU, a specific point of a normalized heat release (DRdV) through the following equation $$DRdV: \frac{P_{diff}\frac{dV}{d\theta}}{\max\left(P_{diff}\frac{dV}{d\theta}\right)}$$

wherein V is a combustion chamber volume; and detecting, by the ECU, a combustion phase based on the calculated specific point of DRdV.

2. The combustion phase detection method of claim 1, wherein the specific point for detecting the combustion phase is within DRdV 0-50% and is within a crank angle of 0-20°.

3. The combustion phase detection method of claim 1, wherein the normalized heat release is divided into a before-peak area and an after-peak area, whereby the before-peak area is related to a first-half stage of combustion (DRdV 0-50%) and the after-peak area is related to a second-half stage of combustion (DRdV 51-100%).

4. The combustion phase detection method of claim 2, wherein the specific point for detecting the combustion phase is DRdV 50% and a crank angle 20°.

5. The combustion phase detection method of claim 1, wherein a normalization method of the DRdV includes:

$$\frac{dQ}{d\theta} = \frac{1}{\gamma-1}V\frac{dP}{d\theta} + \frac{\gamma}{\gamma-1}P\frac{dV}{d\theta} \quad \text{Equation 1}$$

$$\frac{dQ}{d\theta} = \frac{1}{\gamma-1}V\frac{d(P_{diff}+P_{motoring})}{d\theta} + \frac{\gamma}{\gamma-1}(P_{diff}+P_{motoring})\frac{dV}{d\theta}, \quad \text{Equation 2}$$

where $P_{diff} = P - P_{motoring}$ $$\frac{dQ}{d\theta} = \frac{1}{\gamma-1}\left(V\frac{dP_{diff}}{d\theta} + \gamma P_{diff}\frac{dV}{d\theta}\right) + \frac{1}{\gamma-1}\left(V\frac{dP_{motoring}}{d\theta} + \gamma P_{motoring}\frac{dV}{d\theta}\right) \quad \text{Equation 3}$$

$$\frac{dQ}{d\theta} \simeq \frac{1}{\gamma-1}\left(V\frac{dP_{diff}}{d\theta} + \gamma P_{diff}\frac{dV}{d\theta}\right) \quad \text{Equation 4}$$

calculating Equation 2 and Equation 3 by applying a motoring pressure and a pressure difference that is formed by a combustion instead of a cylinder measure pressure P in the above heat-release Equation 1:

calculating Equation 4 as an approximate heat release value by ignoring a heat release rate by the motoring pressure having a very small amount in the above Equation 3; and normalizing the equation of claim 1 by using the above Equation 4.

6. A combustion phase detection system, comprising an engine that uses a combustion energy to generate power; and an ECU that detects a combustion timing, and that performs:

determining a pressure difference (Pdiff) between a cylinder measure combust pressure (P) and a motoring pressure (Pmotoring), wherein Pdiff=P−Pmotoring; and calculating a specific point of a normalized heat release (DRdV) through the following equation $$DRdV: \frac{P_{diff}\frac{dV}{d\theta}}{\max\left(P_{diff}\frac{dV}{d\theta}\right)}$$

wherein the Pdiff (P−Pmotoring) is a difference between a cylinder measure combust pressure (P) and a motoring pressure (Pmotoring), and V is a combustion chamber volume; and detecting a combustion phase based on the calculated specific point of DRdV.

7. The combustion phase detection system of claim 6, wherein the specific point for detecting the combustion phase is within DRdV 0-50% and is within a crank angle of 0-20°.

8. The combustion phase detection method of claim 6, wherein the normalized heat release is divided into a before-peak area and an after-peak area, whereby the before-peak area is related to a first-half stage of combustion (DRdV 0-50%) and the after-peak area is related to a second-half stage of combustion (DRdV 51-100%).

9. The combustion phase detection system of claim 7, wherein the specific point for detecting the combustion phase is DRdV 50% and a crank angle 20°.

10. The combustion phase detection system of claim 6, wherein the ECU performs a normalization method of the DRdV including:

$$\frac{dQ}{d\theta} = \frac{1}{\gamma-1}V\frac{dP}{d\theta} + \frac{\gamma}{\gamma-1}P\frac{dV}{d\theta} \quad \text{Equation 1}$$

$$\frac{dQ}{d\theta} = \frac{1}{\gamma-1}V\frac{d(P_{diff}+P_{motoring})}{d\theta} + \frac{\gamma}{\gamma-1}(P_{diff}+P_{motoring})\frac{dV}{d\theta}, \quad \text{Equation 2}$$

where $P_{diff} = P - P_{motoring}$ $$\frac{dQ}{d\theta} = \frac{1}{\gamma-1}\left(V\frac{dP_{diff}}{d\theta} + \gamma P_{diff}\frac{dV}{d\theta}\right) + \frac{1}{\gamma-1}\left(V\frac{dP_{motoring}}{d\theta} + \gamma P_{motoring}\frac{dV}{d\theta}\right) \quad \text{Equation 3}$$

$$\frac{dQ}{d\theta} \simeq \frac{1}{\gamma-1}\left(V\frac{dP_{diff}}{d\theta} + \gamma P_{diff}\frac{dV}{d\theta}\right) \quad \text{Equation 4}$$

means for calculating Equations 2 and 3 by applying a motoring pressure and a pressure difference that is formed by a combustion instead of a cylinder measure pressure P in the above heat release Equation 1;

means for calculating Equation 4 as an approximate heat release value by ignoring a heat release rate by the motoring pressure having a very small amount in Equation 3; and means for normalizing the equation of claim 5 using the above Equation 4.

* * * * *